US009326566B2

(12) United States Patent
Beers et al.

(10) Patent No.: US 9,326,566 B2
(45) Date of Patent: May 3, 2016

(54) FOOTWEAR HAVING COVERABLE MOTORIZED ADJUSTMENT SYSTEM

(71) Applicant: NIKE, Inc., Beaverton, OR (US)

(72) Inventors: Tiffany A. Beers, Portland, OR (US); Wilson W. Smith, III, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 89 days.

(21) Appl. No.: 14/253,102

(22) Filed: Apr. 15, 2014

(65) Prior Publication Data

US 2015/0289596 A1 Oct. 15, 2015

(51) Int. Cl.

| | |
|---|---|
| ***A43C 11/00*** | (2006.01) |
| ***A43B 3/26*** | (2006.01) |
| ***A43B 23/00*** | (2006.01) |
| ***A43C 11/22*** | (2006.01) |
| ***A43B 23/24*** | (2006.01) |
| ***A43C 11/16*** | (2006.01) |

(52) U.S. Cl.

CPC . *A43C 11/22* (2013.01); *A43B 3/26* (2013.01); *A43B 23/24* (2013.01); *A43C 11/00* (2013.01); *A43C 11/165* (2013.01)

(58) Field of Classification Search

CPC ..... A43C 11/22; A43C 11/165; A43B 23/24; A43B 3/26; A43B 3/242; A43B 11/00; A43B 5/0435

USPC ..... 36/136, 83, 100, 101, 138, 50.1, 97, 8.4

See application file for complete search history.

(56) References Cited

U.S. PATENT DOCUMENTS

| | | | | |
|---|---|---|---|---|
| 1,702,583 | A | 2/1929 | Williams | |
| 1,916,483 | A | 7/1933 | Krichbaum | |
| 2,076,514 | A * | 4/1937 | Howard | A43B 3/0078 36/34 B |
| 3,122,805 | A * | 3/1964 | Hakim | A43C 7/00 24/712.3 |
| 3,187,342 | A | 6/1965 | Aileo | |
| 3,430,303 | A | 3/1969 | Donald | |
| 3,549,878 | A | 12/1970 | Bailey | |
| 3,859,496 | A | 1/1975 | Giese | |
| 4,011,634 | A | 3/1977 | Olivieri | |
| 4,020,571 | A | 5/1977 | Olivieri | |

(Continued)

FOREIGN PATENT DOCUMENTS

| | | |
|---|---|---|
| DE | 29817003 U1 | 3/1999 |
| DE | 19833801 A1 | 2/2000 |

(Continued)

OTHER PUBLICATIONS

International Search Report and Written Opinion mailed May 7, 2015 in PCT/US2015/012337.

(Continued)

*Primary Examiner* — Jila M Mohandesi
*Assistant Examiner* — Katharine Gracz
(74) *Attorney, Agent, or Firm* — Plumsea Law Group, LLC

(57) ABSTRACT

An article of footwear may include a motorized tensioning system including a tensile member and a motorized tightening device attached to an outer surface of the article of footwear, the tightening device configured to apply tension in the tensile member to adjust the size of an internal void defined by the article of footwear. The article of footwear may also include a tightening device cover configured to be removably attached to the article of footwear over the tightening device.

15 Claims, 12 Drawing Sheets

(56) References Cited

U.S. PATENT DOCUMENTS 4,037,333 A 7/1977 Olivieri
4,090,278 A 5/1978 Olivieri
4,130,949 A 12/1978 Seidel
4,253,217 A 3/1981 Marzocchi
4,310,951 A 1/1982 Riedel
4,326,320 A 4/1982 Riedel
4,424,636 A 1/1984 Everest
4,433,456 A 2/1984 Baggio
4,453,290 A 6/1984 Riedel
4,619,057 A 10/1986 Sartor et al.
4,654,985 A * 4/1987 Chalmers ..... A43B 3/0084 24/68 SK
4,697,360 A 10/1987 Sartor
4,712,319 A * 12/1987 Goria ..... A43B 1/0036 359/518
4,724,626 A * 2/1988 Baggio ..... A43B 5/0435 24/68 SK
4,741,115 A * 5/1988 Pozzobon ..... A43B 5/0433 24/68 SK
4,771,556 A * 9/1988 Kim ..... A43B 3/0021 36/136
4,780,968 A 11/1988 Bragagnolo
4,787,124 A 11/1988 Pozzobon et al.
4,800,659 A 1/1989 Marega
4,802,290 A 2/1989 Marega
4,841,649 A 6/1989 Baggio et al.
4,942,678 A 7/1990 Gumbert
5,026,087 A * 6/1991 Wulf ..... A43B 5/0417 280/613
5,105,566 A 4/1992 Legon
5,129,130 A 7/1992 Lecouturier
5,175,949 A * 1/1993 Seidel ..... A43B 5/0435 36/117.8
5,205,055 A * 4/1993 Harrell ..... A43B 5/1633 36/50.1
5,307,569 A * 5/1994 Melcher ..... A43D 999/00 36/50.1
5,327,662 A * 7/1994 Hallenbeck ..... A43C 11/00 36/50.1
5,341,583 A * 8/1994 Hallenbeck ..... A43C 11/16 36/50.1
5,381,609 A 1/1995 Hieblinger
5,425,185 A 6/1995 Gansler
5,456,393 A 10/1995 Mathis et al.
5,467,537 A 11/1995 Aveni et al.
5,469,640 A 11/1995 Nichols
5,495,682 A 3/1996 Chen
5,502,903 A * 4/1996 Barker ..... A43B 1/0036 36/136
5,511,325 A * 4/1996 Hieblinger ..... A43C 11/00 36/105
5,555,650 A 9/1996 Longbottom et al.
5,642,574 A * 7/1997 Caddy ..... A43B 7/02 36/136
5,673,499 A * 10/1997 Attilieni ..... A43B 1/0036 36/137
5,692,324 A 12/1997 Goldston et al.
5,755,044 A 5/1998 Veylupek
5,791,068 A * 8/1998 Bernier ..... A43B 1/0072 36/50.1
5,836,899 A 11/1998 Reilly
5,839,210 A * 11/1998 Bernier ..... A43B 1/0072 36/138
5,930,921 A * 8/1999 Sorofman ..... A43B 1/0036 36/137
5,934,599 A * 8/1999 Hammerslag ..... A43C 1/00 242/396.1
6,018,890 A 2/2000 Bowen
6,032,387 A * 3/2000 Johnson ..... A43C 1/06 36/118.1
6,052,924 A * 4/2000 Sabat ..... A43B 3/0031 36/132
6,148,489 A 11/2000 Dickie et al.
6,202,953 B1 3/2001 Hammerslag
6,289,558 B1 * 9/2001 Hammerslag ..... A43B 5/16 24/68 SK
6,289,609 B1 9/2001 Bowen
6,427,361 B1 * 8/2002 Chou ..... A43B 11/00 36/138
6,449,878 B1 9/2002 Lyden
6,467,194 B1 * 10/2002 Johnson ..... A43C 1/06 36/118.1
6,601,042 B1 7/2003 Lyden
6,681,504 B2 1/2004 Kinan
6,691,443 B1 2/2004 Slayden
6,751,490 B2 6/2004 Esenaliev et al.
6,862,820 B2 3/2005 Farys et al.
6,877,256 B2 * 4/2005 Martin ..... A43B 3/0047 36/114
6,892,429 B2 5/2005 Sartor et al.
6,896,128 B1 * 5/2005 Johnson ..... A43C 1/06 36/118.1
6,922,917 B2 * 8/2005 Kerns ..... A43B 5/14 36/50.1
7,059,070 B2 * 6/2006 Omstead ..... A43B 1/0036 36/137
7,065,906 B2 6/2006 Jones et al.
7,096,559 B2 * 8/2006 Johnson ..... A43B 11/00 29/433
7,200,957 B2 4/2007 Hubbard et al.
7,287,342 B2 10/2007 Keen
7,367,522 B2 5/2008 Chen
7,503,131 B2 * 3/2009 Nadel ..... A43B 5/0415 36/117.1
7,584,528 B2 9/2009 Hu
7,591,050 B2 * 9/2009 Hammerslag ..... A43B 5/16 24/68 SK
7,661,205 B2 * 2/2010 Johnson ..... A43C 7/04 36/50.1
7,676,960 B2 3/2010 DiBenedetto et al.
7,721,468 B1 * 5/2010 Johnson ..... A43C 1/06 36/118.1
7,752,774 B2 * 7/2010 Ussher ..... A43B 3/0005 36/100
7,950,112 B2 5/2011 Hammerslag et al.
7,954,204 B2 6/2011 Hammerslag et al.
7,980,009 B2 7/2011 Carnes et al.
7,992,261 B2 8/2011 Hammerslag et al.
8,020,320 B2 9/2011 Gillespie
8,046,937 B2 * 11/2011 Beers ..... A43B 3/0005 24/68 SK
8,056,269 B2 * 11/2011 Beers ..... A43B 1/0027 36/137
8,061,061 B1 * 11/2011 Rivas ..... A43B 3/001 24/68 SK
8,074,379 B2 12/2011 Robinson, Jr. et al.
8,087,188 B2 * 1/2012 Labbe ..... A43B 11/00 24/712
8,091,182 B2 1/2012 Hammerslag et al.
8,141,277 B2 3/2012 Robinson et al.
8,151,490 B2 4/2012 Sokolowski
8,231,074 B2 * 7/2012 Hu ..... A43C 11/165 24/68 SK
8,387,282 B2 3/2013 Baker et al.
8,387,284 B2 * 3/2013 Baum ..... A43B 1/0027 36/100
2002/0043007 A1 4/2002 Hannah
2002/0095750 A1 7/2002 Hammerslag
2003/0150135 A1 * 8/2003 Liu ..... A43B 3/0005 36/50.1
2004/0128863 A1 7/2004 Hong et al.
2004/0159022 A1 * 8/2004 Winford ..... A43B 1/0027 36/136
2004/0226194 A1 * 11/2004 Schenone ..... A43B 3/0078 36/112
2005/0005478 A1 * 1/2005 James ..... A43B 3/0078 36/132
2005/0098673 A1 5/2005 Huang
2005/0102861 A1 5/2005 Martin
2006/0000116 A1 1/2006 Brewer
2006/0116483 A1 6/2006 Tonkel
2006/0143951 A1 * 7/2006 Yang ..... A43B 3/0078 36/100

(56) References Cited

U.S. PATENT DOCUMENTS

| | | | | |
|---|---|---|---|---|
| 2006/0156517 | A1 | 7/2006 | Hammerslag et al. | |
| 2006/0201031 | A1 | 9/2006 | Jones et al. | |
| 2007/0000105 | A1 | 1/2007 | Grande et al. | |
| 2007/0011914 | A1 | 1/2007 | Keen et al. | |
| 2007/0043630 | A1 | 2/2007 | Lyden | |
| 2007/0130805 | A1* | 6/2007 | Brady | A43B 3/0078 36/136 |
| 2007/0169378 | A1 | 7/2007 | Sodeberg et al. | |
| 2007/0278911 | A1 | 12/2007 | Vallance et al. | |
| 2008/0022558 | A1* | 1/2008 | Kaufer | A43B 3/0031 36/100 |
| 2008/0060167 | A1 | 3/2008 | Hammerslag et al. | |
| 2008/0066272 | A1 | 3/2008 | Hammerslag et al. | |
| 2008/0066345 | A1* | 3/2008 | Hammerslag | A43B 5/16 36/50.1 |
| 2008/0066346 | A1* | 3/2008 | Hammerslag | A43B 5/16 36/50.1 |
| 2008/0083135 | A1* | 4/2008 | Hammerslag | A43B 5/16 36/50.5 |
| 2008/0163514 | A1* | 7/2008 | Stassinopoulos | A43B 1/0081 36/100 |
| 2008/0222917 | A1 | 9/2008 | Dojan et al. | |
| 2008/0235990 | A1 | 10/2008 | Wegener | |
| 2008/0307673 | A1 | 12/2008 | Johnson | |
| 2009/0055044 | A1 | 2/2009 | Dienst | |
| 2009/0184189 | A1 | 7/2009 | Soderberg et al. | |
| 2009/0199436 | A1* | 8/2009 | Franklin | A43B 23/24 36/114 |
| 2009/0205221 | A1 | 8/2009 | Mitchell | |
| 2009/0272007 | A1* | 11/2009 | Beers | A43B 3/0005 36/50.1 |
| 2009/0288317 | A1* | 11/2009 | Forbes | A43B 3/00 36/136 |
| 2010/0000126 | A1* | 1/2010 | Ortner | A43B 1/0054 36/101 |
| 2010/0005686 | A1* | 1/2010 | Baum | A43B 1/0027 36/100 |
| 2010/0014045 | A1* | 1/2010 | MacCallum | A43B 1/0054 351/52 |
| 2010/0037488 | A1* | 2/2010 | Moffitt | A43B 1/0081 36/136 |
| 2010/0050403 | A1* | 3/2010 | Kimes | A43C 11/16 24/68 B |
| 2010/0101116 | A1 | 4/2010 | Serafino et al. | |
| 2010/0107446 | A1* | 5/2010 | Peet | A43B 23/24 36/100 |
| 2010/0139057 | A1 | 6/2010 | Soderberg et al. | |
| 2010/0192419 | A1* | 8/2010 | Jack | A43B 1/0054 36/132 |
| 2010/0223816 | A1* | 9/2010 | Barfield | A43B 3/0005 36/136 |
| 2010/0251524 | A1 | 10/2010 | Chen et al. | |
| 2010/0299959 | A1 | 12/2010 | Hammerslag et al. | |
| 2011/0083341 | A1* | 4/2011 | Baum | A43B 1/0027 36/100 |
| 2011/0175744 | A1 | 7/2011 | Englert et al. | |
| 2011/0225843 | A1 | 9/2011 | Kerns et al. | |
| 2011/0258876 | A1 | 10/2011 | Baker et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0005923 | A1 | 1/2012 | Beers et al. | |
| 2012/0117821 | A1 | 5/2012 | Adams et al. | |
| 2012/0192457 | A1 | 8/2012 | Youngs | |
| 2012/0192461 | A1* | 8/2012 | Backus | F16B 5/0657 36/136 |
| 2012/0246974 | A1* | 10/2012 | Hammerslag | A43B 5/16 36/83 |
| 2013/0312293 | A1 | 11/2013 | Gerber | |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2014/0094728 | A1 | 4/2014 | Soderberg et al. | |

FOREIGN PATENT DOCUMENTS

| | | | |
|---|---|---|---|
| DE | 10109673 | A1 | 9/2002 |
| DE | 102005036013 | A1 | 2/2007 |
| EP | 1064863 | A1 | 1/2001 |
| FR | 2827486 | A1 | 1/2003 |
| GB | 2 449 722 | A | 12/2008 |
| GB | 2449722 | A | 12/2008 |
| JP | 2005-36374 | A | 2/2005 |
| WO | 01/05559 | A1 | 3/2001 |
| WO | 01/64066 | A2 | 9/2001 |
| WO | 2009071652 | A1 | 6/2009 |
| WO | 2009134858 | A1 | 11/2009 |
| WO | 2014036371 | A1 | 3/2014 |
| WO | 2014036374 | A1 | 3/2014 |
| WO | 2015160406 | | 10/2015 |

OTHER PUBLICATIONS

International Preliminary Report on Patentability (including Written Opinion of the ISA) mailed Mar. 12, 2015 in International Application No. PCT/US2013/057462.

International Preliminary Report on Patentability (including Written Opinion of the ISA) mailed Mar. 12, 2015 in International Application No. PCT/US2013/057467.

International Search Report and Written Opinion mailed Dec. 22, 2014 in PCT/US2014056207.

International Search Report and Written Opinion mailed Jul. 20, 2015 in PCT/US2015/025725.

Blake Bevin, Power Laces Prototype Version 1, Uploaded Jul. 4, 2010 http://www.youtube.com/watch?v=ROEZs0HpFQc &feature=endscreen&NR=1.

Blake Bevin, Power Laces Prototype Version 2, Uploaded Aug. 29, 2010 http://www.youtube.com/watch?v=k_Efr2TaEPo.

Blake Bevin, Power-Laces.com Archived, About the Project, Aug. 18, 2012.

International Search Report and Written Opinion mailed Jan. 3, 2014 in PCT/US2013/057462.

International Search Report and Written Opinion mailed Jan. 3, 2014 in PCT/US2013/057467.

* cited by examiner

FOOTWEAR HAVING COVERABLE MOTORIZED ADJUSTMENT SYSTEM

BACKGROUND

The present embodiments relate generally to articles of footwear and including coverable motorized adjustment systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

In some cases, the lacing system may include a motorized tensioning system. Components of a motorized tensioning system may include, for example, a motorized tightening device, a control board, and a battery. Each of these components may be incorporated into an article of footwear in various places. In some cases, these components may be mounted on an outer portion of the footwear upper. In such configurations, it may be desirable to celebrate the inclusion of these components on the footwear while concealing their outward appearance and protecting these components from damage.

SUMMARY

In some embodiments, the disclosed footwear may include individual covers configured to cover lace tensioning system components on the outer surface of the footwear upper. Such covers may include faceted surfaces configured to define a contoured cavity enclosing the tensioning system components.

In one aspect, the present disclosure is directed to an article of footwear, including a motorized tensioning system including a tensile member and a motorized tightening device attached to an outer surface of the article of footwear, the tightening device configured to apply tension in the tensile member to adjust the size of an internal void defined by the article of footwear. The article of footwear may also include a tightening device cover configured to be removably attached to the article of footwear over the tightening device.

In another aspect, the present disclosure is directed to a motorized footwear lacing system. The system may include an article of footwear having a motorized tensioning system including a tensile member and a motorized tightening device attached to an outer surface of the article of footwear, the tightening device configured to apply tension in the tensile member to adjust the size of an internal void defined by the article of footwear. The system may also include a control unit and a power source incorporated into the motorized tensioning system, the control unit and the power source being attached to an outer surface of the article of footwear. Further, the system may include a first set of component covers configured to be removably attached to the outer surface of the article of footwear, the first set of component covers including a first tightening device cover configured to be removably attached over the tightening device, a first control unit cover configured to be removably attached over the control unit, and a first power source cover configured to be removably attached over the power source. In addition, the system may include a second set of component covers configured to be removably attached to the outer surface of the article of footwear, the second set of component covers including a second tightening device cover configured to be removably attached over the tightening device, a second control unit cover configured to be removably attached over the control unit, and a second power source cover configured to be removably attached over the power source. Also, the first tightening device cover may be interchangeable with the second tightening device cover, the first control unit cover is interchangeable with the second control unit cover, and the first power source cover may be interchangeable with the second power source cover.

In another aspect, the present disclosure is directed to a method of changing a lacing system of an article of footwear. The method may include providing an article of footwear including a motorized tensioning system attached to the article of footwear, the motorized tensioning system including a tensile member laced through eye stays in a lacing region of the article of footwear, a motorized tightening device configured to apply tension in the tensile member to adjust the size of an internal void defined by the article of footwear, a first tightening device cover removably attached to the article of footwear over the tightening device, and a second tightening device cover configured to be removably attached to the article of footwear, the second tightening device cover having a different exterior shape than the first tightening device cover. The method may also include removing the first tightening device cover from the article of footwear and removably attaching the second tightening device cover to the article of footwear over the tightening device.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The drawings are schematic and, accordingly, the components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
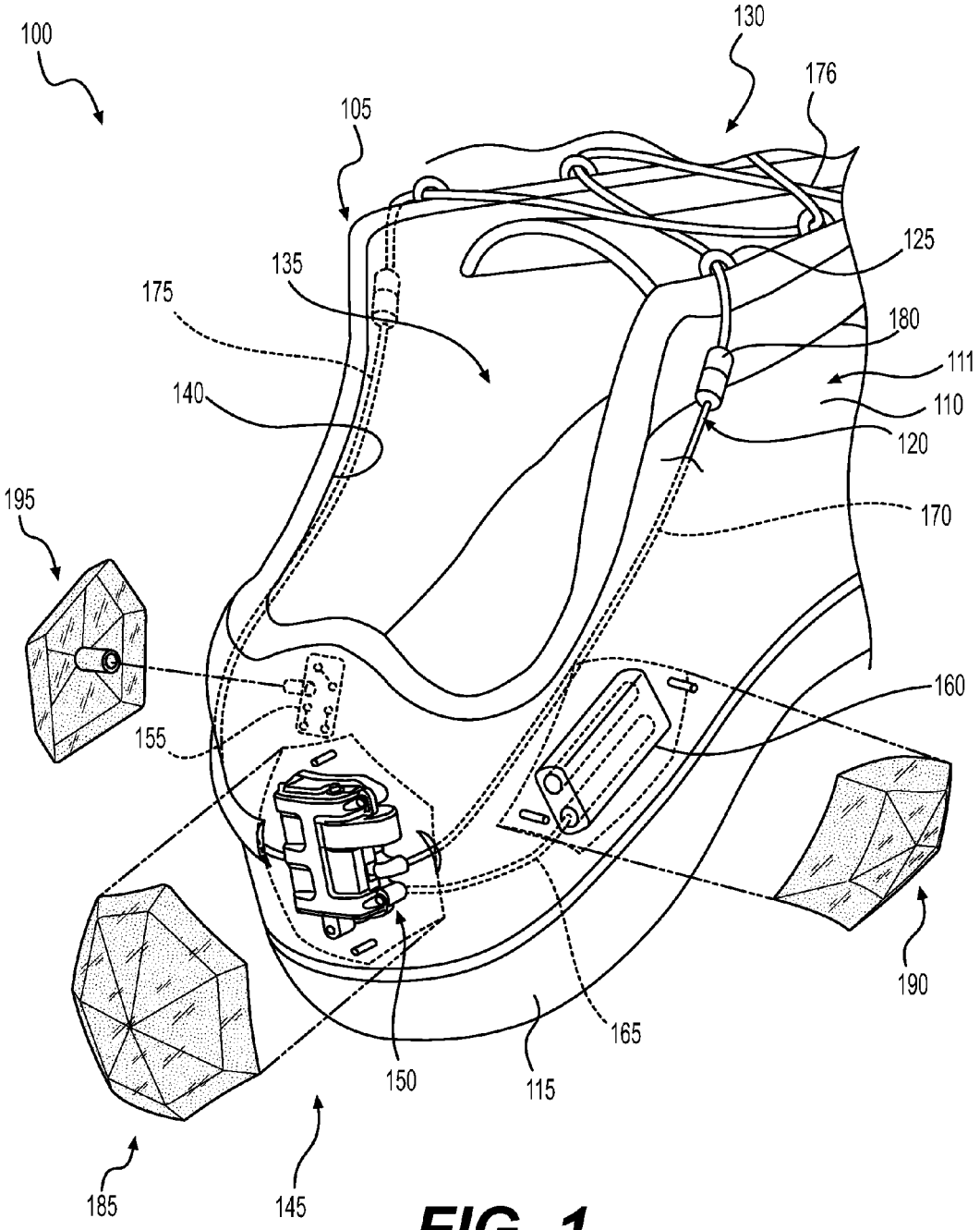
FIG. 1 is a schematic illustration of an exploded, rear perspective view of an article of footwear including a motorized tensioning system and individual covers for the components of the tensioning system.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends from a forefoot region to a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors.

A motorized footwear lacing system may include an article of footwear and a motorized tensioning system. The motorized tensioning system may include a tensile member and a motorized tightening device. In some embodiments, the lacing system may be provided as a kit of parts, including a container in which a pair of footwear, a pair of motorized tensioning systems, and a remote device may be provided. The tensile member may include a cord or other lace-like member that attaches to the motorized tightening device. In some embodiments, the cord may be laced through lace receiving members in a lacing region of the article of footwear. In some embodiments, the footwear may include one or more removable covers configured to be removably attached to the upper of the article of footwear over the components of the tensioning system.

The motorized tensioning system enables relatively rapid tightening of the footwear. In addition, in some embodiments the tightening system may provide incremental tightening. Such incremental tightening may enable the user to achieve a predictable tightness for each wearing. In some embodiments, sensors may be included to monitor tightness. In such embodiments, the user may also achieve a predictable tightness.

In some cases, using a motorized tightening device may remove dexterity issues that may occur with other tensioning technologies (pulling straps, Velcro, and other such manual closure systems). Such a design could improve the use of footwear for physically impaired or injured individuals who may otherwise have a hard time putting on and adjusting their footwear. Using the designs proposed here, footwear could be tightened via a push button or remote interface.

In some embodiments, the tensioning system may be remotely controlled, for example by a bracelet or hand-held device, such as a mobile phone. In such embodiments, adjustments may be made without the wearer having to stop the activity in which they are participating. For example, a distance runner may adjust the tightness of their footwear without interrupting their workout or competitive event to bend over and adjust their footwear manually or by pressing buttons on the footwear to activate the motorized tensioning system.

In addition, the tensioning system may also be configured to make automatic adjustments. For example, using tightness sensors, the system may be configured to maintain tightness during wear by adjusting tightness according to changes in the fit. For example, as feet swell during wear, the tensioning system may release tension on the tensile member, in order to maintain the initially selected tightness.

Further, the tensioning system may be configured to adjust the tightness during use to improve performance. For example, as a wearer places loads on the footwear during an athletic activity, the system may tighten or loosen the tensile members to achieve desired performance characteristics. For example, as a runner proceeds around a curve, the tensioning system may tighten the footwear in order to provide additional stability and maintain the foot in a centralized position within the footwear. As another example, when a runner is running downhill, the tightening system may loosen the footwear to limit additional forces exerted on the foot as the foot tends to slide toward the front of the footwear during the downhill run. Numerous other automated adjustments may be utilized for performance. Such automated adjustments may vary for each activity. In addition, the type and amount of such adjustments may be preselected by the user. For instance, using the examples above, the user may select whether to tighten or loosen the footwear while proceeding around a curve. In addition, the user may select whether to utilize an automated adjustment at all during certain conditions. For example, the user may choose to implement the adjustment while proceeding around curves, but may opt not to utilize an adjustment when running downhill.

FIG. 1 shows a motorized footwear lacing system 100. As shown in FIG. 1, system 100 may include an article of footwear 105. FIG. 1 shows a partial rear perspective view of footwear 105, the forefoot portion of which has been truncated for purposes of illustration. Footwear 105 may be any of a variety of footwear types, including athletic footwear, such as running shoes, basketball shoes, soccer shoes, cross-training shoes, baseball shoes, football shoes, and golf shoes, for example. In other embodiments, footwear 105 may be another type of footwear including, but not limited to, hiking boots, casual footwear, such as dress shoes, as well as any other kinds of footwear. Accordingly, the disclosed concepts may be applicable to a wide variety of footwear types.

As shown in FIG. 1, footwear 105 may include an upper 110 and a sole structure 115 secured to upper 110. Upper 110 may include one or more material elements (for example, meshes, textiles, foam, leather, and synthetic leather), which may be joined to define an interior void 135 configured to receive a foot of a wearer. The material elements may be selected and arranged to selectively impart properties such as light weight, durability, air-permeability, wear-resistance, flexibility, and comfort. Upper 110 may define a throat opening 140 through which a foot of a wearer may be received into void 135.

Sole structure 115 may be fixedly attached to upper 110 (for example, with adhesive, stitching, welding, or other suitable techniques) and may have a configuration that extends between upper 110 and the ground. Sole structure 115 may include provisions for attenuating ground reaction forces (that is, cushioning and stabilizing the foot during vertical and horizontal loading). In addition, sole structure 115 may be configured to provide traction, impart stability, and control or limit various foot motions, such as pronation, supination, or other motions.

The configuration of sole structure 115 may vary significantly according to one or more types of ground surfaces on which sole structure 115 may be used. For example, the disclosed concepts may be applicable to footwear configured for use on any of a variety of surfaces, including indoor surfaces or outdoor surfaces. The configuration of sole structure 115 may vary based on the properties and conditions of the surfaces on which footwear 105 is anticipated to be used. For example, sole structure 115 may vary depending on whether the surface is harder or softer. In addition, sole structure 115 may be tailored for use in wet or dry conditions.

Upper 110 may also form a lacing region 130. In some embodiments, lacing region 130 may be disposed in an instep region of footwear 105, as shown in FIG. 1. In other embodiments, the lacing region may be disposed on other portions of the footwear, such as the medial and/or lateral sides of the footwear. As further shown in FIG. 1, footwear 105 may include a plurality of lace receiving members 125 in lacing region 130. Lace receiving members 125 may be configured to receive a lace or tensile member for adjusting the fit of footwear 105.

The arrangement of lace receiving members 125 in this embodiment is only intended to be exemplary and it will be understood that other embodiments are not limited to a particular configuration for lace receiving members 125. Furthermore, the particular types of lace receiving members 125 illustrated in the embodiments are also exemplary and other embodiments may incorporate any other kinds of lace receiving members or similar lacing provisions. In some other embodiments, for example, footwear 105 may include traditional eyelets. Some examples of lace guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System" (the "Reel Based Lacing Application"), the disclosure of which is incorporated herein by reference in its entirety. Still additional examples of lace receiving members are disclosed in Kerns et al., U.S. Patent Application Publication Number 2011/0225843, published Sep. 22, 2011 and entitled "Guides For Lacing Systems," the disclosure of which is incorporated herein by reference in its entirety.

Footwear 105 may also be configured with a motorized tensioning system 145. Tensioning system 145 may comprise various components and systems for adjusting the size of opening 140 and thereby tightening (or loosening) upper 110 around a wearer's foot. In some embodiments, tensioning system 145 may comprise a tensile member 120 and a motorized tightening device 150 configured to apply tension in tensile member 120. In some embodiments, tightening device 150 may be attached to an outer surface of footwear 105. For example, as shown in FIG. 1, in some embodiments, tightening device 150 may be attached to an outer surface 111 of upper 110.

Tightening device 150 may be configured to apply tension in tensile member 120 to adjust the size of internal void 135 defined by footwear 105. In some embodiments, tightening device 150 may include provisions for winding and unwinding portions of tensile member 120. Tightening device may include a motor. In some embodiments, the motor may be an electric motor. However, in other embodiments, the motor could comprise any kind of non-electric motor known in the art. Examples of different motors that can be used include, but are not limited to: DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Tensile member 120 may be configured to pass through various different lace receiving members 125 in lacing region 130. In some cases, lace receiving members 125 may provide a similar function to traditional eyelets on uppers. In particular, as tensile member 120 is pulled or tensioned, throat opening 140 may generally constrict so that upper 110 is tightened around a foot.

Tensile member 120 may comprise any type of type of lacing material known in the art. Examples of lace that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing Application mentioned above. The term "tensile member," as used throughout this detailed description and in the claims, refers to any component that has a generally elongated shape and high tensile strength. In some cases, a tensile member could also have a generally low elasticity. Examples of different tensile members include, but are not limited to: laces, cables, straps and cords. In some cases, tensile members may be used to fasten and/or tighten an article footwear.

In some embodiments, tensile member 120 may be provided in sections. For example, tensile member 120 may include a first tensile member portion 170. In addition, tensile member 120 may include a second tensile member portion 175. Also, tensile member 120 may include a third tensile member portion 176. Third tensile member portion 176 may be laced into footwear 105 through lace receiving members 125. First tensile member portion 170 and second tensile member portion 175 may be releasably fastened to third tensile member portion 176. For example, in some embodiments, tensile member 120 may include one or more quick release couplings 180, by which first tensile member portion 170, second tensile member portion 175, and third tensile member portion 176 may be releasably joined. Without first tensile member portion 170 and second tensile member portion 175 attached, third tensile member portion 176 may be used as, or be replaced by, a manual (i.e., traditional) shoelace.

Couplings 180 may be readily decoupled manually, in order to enable removal of tensile member 120 from the article of footwear. Such manual decoupling may facilitate removal of the motorized tensioning system from footwear 105. This manual release mechanism may also enable the tension in the tensile member to be released in the event of a malfunction or low battery power. Exemplary manual release mechanisms may include any suitable connector types. In some embodiments, threaded connections may be utilized. In other embodiments the tensile member could utilize any other fastening provisions including a snap fit connector, a hook and receiver type connector, or any other kinds of manual fasteners known in the art.

In some embodiments, tensile member 120 may be passed through lace receiving members 125 and may pass through internal channels within upper 110, between lacing region and tightening device 150, as shown in FIG. 1. In some embodiments, the internal channels may extend around the sides of upper 110 and guide tensile member 120 towards motorized tightening device 150, which may be mounted on a heel portion of upper 110, as shown in FIG. 1. In some cases, motorized tightening device 150 may include provisions for receiving portions of tensile member 120. For example, in some cases, end portions of tensile member 120 may pass through apertures in a housing unit of motorized tightening device 150.

As further shown in FIG. 1, tensioning system 145 may also include a control unit 155 configured to control the operation of tightening device 150. In some embodiments, control unit 155 may be attached to the outer surface of footwear, such as outer surface 111 of upper 110. Control unit 155 may include various circuitry components. In addition, control unit 155 may include a processor, configured to control motorized tightening device 150.

Control unit 155 shown in FIG. 1 is only intended as a schematic representation of one or more control technologies that could be used with tightening device 150. For example, there are various approaches to motor control that may be employed to allow speed and direction control. For some embodiments, a microcontroller unit may be used. The microcontroller may use internal interrupt generated timing pulses to create pulse-width modulation (PWM) output. This PWM output is fed to an H-bridge which allows high current PWM pulses to drive the motor both clockwise and counterclockwise with speed control. However, any other methods of motor control known in the art could also be used.

Tensioning system 145 may also include a power source 160 configured to supply power to motorized tightening device 150. In some embodiments, power source 160 may include one or more batteries. Power source 160 shown in FIG. 1 is only intended as a schematic representation of one or more types of battery technologies that could be used to power motorized tightening device 150. One possibly battery technology that could be used is a lithium polymer battery. The battery (or batteries) could be rechargeable or replaceable units packaged as flat, cylindrical, or coin shaped. In addition, batteries could be single cell or cells in series or parallel.

Rechargeable batteries could be recharged in place or removed from an article for recharging. In some embodiments, charging circuitry could be built in and on board. In other embodiments, charging circuitry could be located in a remote charger. In another embodiment, inductive charging could be used for charging one or more batteries. For example, a charging antenna could be disposed in a sole structure of an article and the article could then be placed on a charging mat to recharge the batteries.

Additional provisions could be incorporated to maximize battery power and/or otherwise improve use. For example, it is also contemplated that batteries could be used in combination with super caps to handle peak current requirements. In other embodiments, energy harvesting techniques could be incorporated which utilize the weight of the runner and each step to generate power for charging a battery.

As shown in FIG. 1, tensioning system 145 may include one or more electrical cables 165 extending between components of system 145. Electrical cables 165 may be configured to deliver electrical power, as well as electronic communication signals, between power source 160, tightening device 150, and control unit 155. In some embodiments, such electrical cables may be disposed under at least one layer of upper 110.

In some embodiments, one or more components of tensioning system 145 may be removable from footwear 105. Providing motorized tensioning system 145 as removable from footwear 105 may enable footwear 105 to be used conventionally. In addition, removability of tensioning system 145 may enable components of tensioning system 145 to be repaired or replaced independent of footwear 145. In addition, removability of tensioning system 145 enables footwear 145 to be repaired or replaced independent of tensioning system 145.

Provisions for mounting components of tensioning system 145 to outer surface 111 of upper 110 can vary in different embodiments. In some cases, motorized tightening device 150 may be removably attached, so that motorized tensioning system 145 can be easily removed by a user and modified (for example, when tensile member 120 must be replaced). For example, in some embodiments, components of tensioning system 145 may be removably attached to footwear 105 with a hook and loop fastener material. In other embodiments, components of tensioning system 145 may be removably attached to footwear 105 with a tongue and groove configuration. Further, in some embodiments, components of tensioning system 145 may be removably attached to footwear 105 with an interference fit or friction fit. The components of such a friction fit attachment may have any suitable orientation. Alternative types of removable connections are also possible including, for example, threaded fasteners, cam-lock fasteners, spring clip type fasteners, and other removable connection mechanisms.

As shown in FIG. 1, tightening device 150 may be configured to be removably attached to a heel portion of footwear 105. For example, as shown in FIG. 1, in some embodiments, tightening device 150 may be removably attached to outer surface 111 of upper 110 in a rearmost portion of footwear 105. This positioning may facilitate the application of tension to tensile members on both a medial side and a lateral side of footwear 110.

In other embodiments, however, any of these components could be disposed in any other portions of an article, including the upper and/or sole structure. In some cases, some components could be disposed in one portion of an article and other components could be disposed in another, different, portion. The location of a motorized tightening device can vary from one embodiment to another. The illustrated embodiments show a motorized tightening device disposed on the heel of an upper. However, other embodiments may incorporate a motorized tightening device in any other location of an article of footwear, including the forefoot and midfoot portions of an upper. In still other embodiments, a motorized tightening device could be disposed in a sole structure of an article. The location of a motorized tightening device may be selected according to various factors including, but not limited to: size constraints, manufacturing constraints, aesthetic preferences, optimal lacing placement, ease of removability as well as possibly other factors.

In another embodiment motorized tightening device 150 could be disposed at the heel of an upper, while power source 160 and/or control unit 155 could be disposed with a sole structure of footwear 110. For example, in one embodiment the power source and control unit may be disposed under midfoot region of footwear 105 with a cable connection (or a simple electrical contact connection) to motorized tightening device 150, which may be disposed in the heel region of footwear 105. In still other embodiments, a power source and a control unit could be integrated into the motorized tightening device. For example, in some embodiments, both a battery and a control unit could be disposed within an outer housing of motorized tightening device 150.

Further, in some embodiments, the locations of tightening device 150, control unit 155, and power source 160 may be rearranged. Control unit 155 is shown in the left side of footwear 105 in FIG. 1. Power source 160 is shown on the right side of footwear 105. The positions of control unit 155 and power source 160 may be reversed in some embodiments. However, it may be advantageous to locate the thinner component on the medial side of footwear 105. This may enable the tensioning system components to have a lower profile on the medial side than on the lateral side of footwear 105, which may minimize possible interference with footwear 105 on the other foot of the wearer.

In some embodiments, motorized tightening device 150 may be configured to automatically regulate tension in tensile member 120 for purposes of tightening, loosening, and regulating the fit of upper 110. Embodiments can incorporate a variety of sensors for providing information to a control unit of a motorized tensioning system. In some embodiments an H-bridge mechanism may be used to measure current. The measured current may be provided as an input to the control unit. In some cases, a predetermined current may be known to correspond to a certain level of tension in the tensile member. By checking the measured current against the predetermined current, a motorized tensioning system may adjust the tension of the tensile member until the predetermined current is measured, which indicates the desired tension has been achieved.

With current as a feedback, a variety of digital control strategies can be used. For instance, proportional control only could be used. Alternatively, PI control could be used or full PID. In cases some cases, simple averaging could be used or other filtering techniques including fuzzy logic and band-pass to reduce noise.

Still other embodiments can include additional types of sensors. In some cases, pressure sensors could be used under the insoles of an article to indicate when the user is standing. A motorized tensioning system can be programmed to automatically loosen the tension of the lace when the user moves from the standing position to a sitting position. Such a configuration may be useful for older adults that may require low tension when sitting to promote blood circulation but high tension for safety when standing.

Still other embodiments could include additional tension sensing elements. In one embodiment, three point bend indicators could be used in the lace to more accurately monitor the state of the tensioning system, including the lace. In other embodiments, various devices to measure deflection such as capacitive or inductive devices could be used. In some other embodiments, strain gauges could be used to measure tension induced strain in one or more components of a tensioning system.

In some embodiments, sensors such as gyroscopes and accelerometers could be incorporated into a tensioning system. In some embodiments, an accelerometer and/or gyroscope could be used to detect sudden moment and/or position information that may be used as feedback for adjusting lace tension. These sensors could also be implemented to control periods of sleep/awake to extend battery life. In some cases, for example, information from these sensors could be used to reduce tension in a system when the user is inactive, and increase tension during periods of greater activity.

Some embodiments may use memory (for example onboard memory associated with a control unit) to store sensed data over time. This data may be stored for later upload and analysis. For example, one embodiment of an article of footwear may sense and store tension information over time that can be later evaluated to look at trends in tightening.

It is also contemplated that some embodiments could incorporate pressure sensors to detect high pressure regions that may develop during tightening. In some cases, the tension of the lace could be automatically reduced to avoid such high pressure regions. Additionally, in some cases, a system could prompt a user to alter them to these high pressure regions and suggest ways of avoiding them (by altering use or fit of the article).

It is contemplated that in some embodiments a user could be provided with feedback through motor pulsing, which generates haptic feedback for the user in the form of vibrations/sounds. Such provisions could facilitate operation of a tensioning system directly, or provide haptic feedback for other systems in communication with a motorized tightening device.

Various methods of automatically operating a motorized tightening device in response to various inputs can be used. For example, after initially tightening a shoe, it is common for the lace tension to quickly decline in the first few minutes of use. Some embodiments of a tensioning system may include provisions for readjusting lace tension to the initial tension set by the user. In some embodiments, a control unit may be configured to monitor tension in those first minutes to then readjust tension to match original tension.

Components of motorized tensioning system 145 may have any suitable configurations. For example, components of motorized tensioning system 145 may have any suitable configurations disclosed in Beers, U.S. Patent Application Publication No. 2014/0082963, published on Mar. 27, 2014, and entitled "Footwear Having Removable Motorized Adjustment System," the entire disclosure of which is incorporated herein by reference.

Mounting the tensioning system components on the outer surface of the upper prevents these components from taking up space in other parts of the shoe, for example, between layers of the upper, or within the sole structure. In some embodiments, removable covers may be attached, covering the individual components of the tensioning system. These covers may enable the inclusion of these components on the footwear to be celebrated, while concealing their outward appearance. For example, the covers may be formed to have any desired appearance and, accordingly, may be used to conceal the appearance of the tightening device, control unit, and/or power source, for instance. In addition, such covers may protect these components from damage.

As shown in FIG. 1, footwear 105 may include a tightening device cover 185 configured to be removably attached to footwear 105 over tightening device 150. In addition, footwear 105 may include a control unit cover 195 configured to be removably attached to footwear 105 over control unit 155, and a power source cover 190 configured to be removably attached to footwear 105. Tightening device cover 185, power source cover 190, and/or control unit cover 195 may be removably attached by any suitable mechanism. For example, as shown in FIG. 1, these covers may be removably attached to the article of footwear with an interference fit connection. Alternative removable connections may be used, such as hook and loop fasteners, threaded fasteners, press-fit connections, snap fit connections, or any other suitable removable connection.

The tensioning system component covers may have any suitable shape. For example, as shown in FIG. 1, tightening device cover 185, power source cover 190, and/or control unit cover 195 may have faceted configurations. For purposes of this disclosure, the term "faceted" shall refer to the inner and/or outer surface of a cover being formed to have a plurality of planar surfaces ("facets") arranged at various angles to one another like a gem. In contrast a "smoothly contoured" surface will be understood to have no adjacent planar surfaces, but instead smoothly curved surfaces.

Further, in some embodiments, these covers may have polygonal outer edges. In some embodiments, one or more of these covers may have regular polygonal shapes. In some embodiments, one or more of these covers may have non-regular polygonal shapes. The faceted configurations may include faceted inner surfaces, which define concave contours configured to receive the tensioning system components.

In some embodiments, one or more of the covers may be transparent or semi-transparent. For example, in some embodiments, one or more of the covers may be formed of a colored, translucent material. Colored, translucent covers having faceted configurations may have a gem-like appearance. Accordingly, utilizing such covers may provide a more aesthetically appealing configuration than a battery pack or circuit board, for example. In addition, such covers may also provide protection to the tensioning system components. The faceted configurations may provide the covers with increased strength over certain non-faceted configurations.

Figure 2:
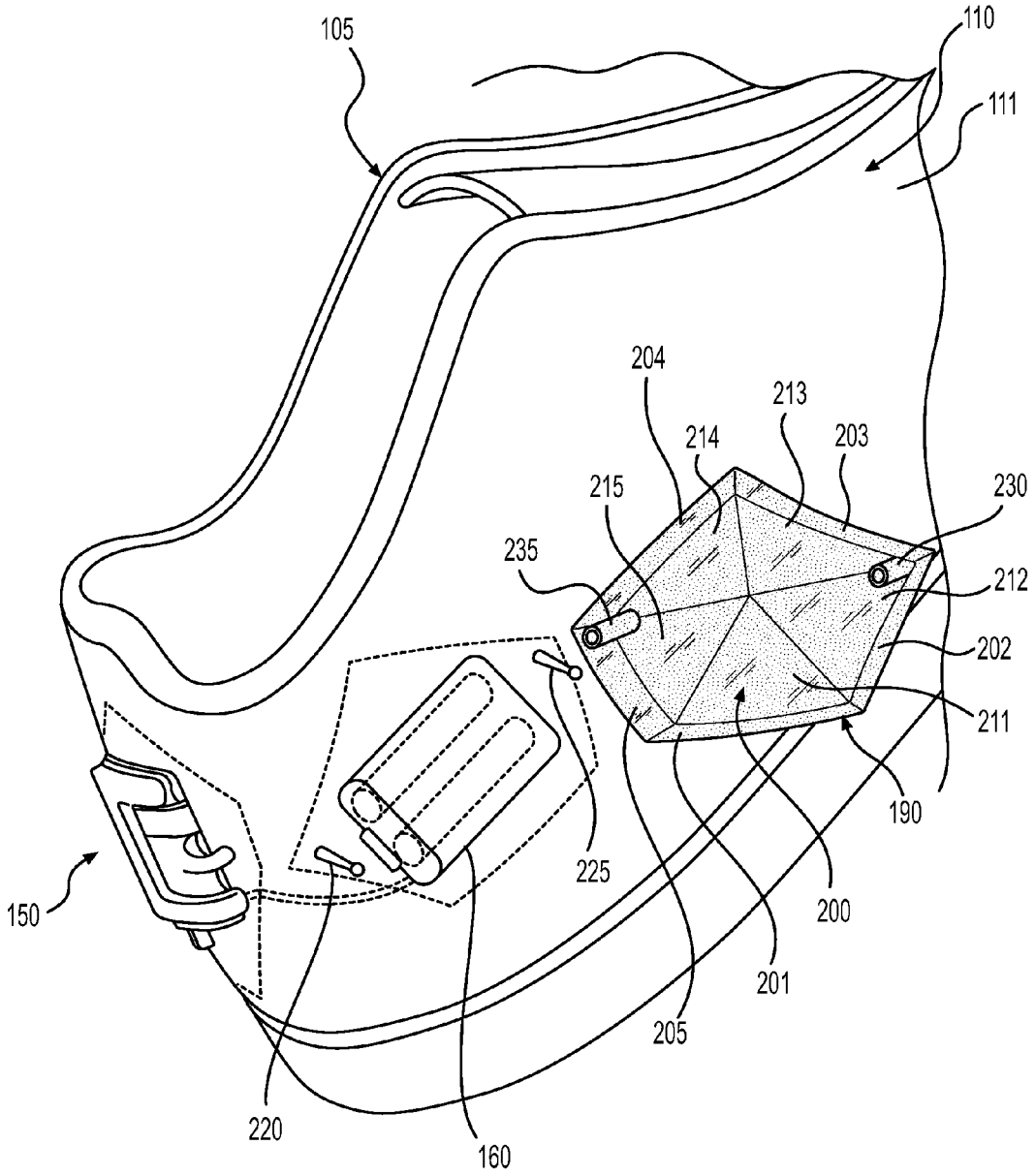
FIG. 2 is a schematic illustration of an exploded, side perspective view of an article of footwear and a power source cover.

FIG. 2 is a schematic illustration of an exploded, side perspective view of footwear 105. FIG. 2 shows concave inner surface 200 of power source cover 190. As shown in FIG. 2, power source cover may have a faceted configuration. For example, inner surface 200 of power source cover 190 may include a first perimeter facet 201, a second perimeter facet 202, a third perimeter facet 203, a fourth perimeter facet 204, and a fifth perimeter facet 205. In addition, inner surface 200 may include a first inner facet 211, a second inner facet 212, a third inner facet 213, a fourth inner facet 214, and a fifth inner facet 215.

As shown in FIG. 2, power source cover 190 may have a generally pentagonal shape. However, other shapes are possible. In addition, in some embodiments, power source cover 190 may be symmetrical. In other embodiments, power source cover 190 may be asymmetrical. The faceted configuration may provide inner surface 200 with a contoured concave shape configured to receive power source 160.

As shown in FIG. 2, power source cover 190 may be configured to be removably attached to outer surface 111 of upper 110 of footwear 105. In some embodiments, power source cover 190 may be removably attached to outer surface 111 by an interference fit connection or a friction fit connection. For example, in some embodiments, upper 110 may include a first attachment post 220 and a second attachment post 225. Power source cover 190 may include a first post receiving cylinder 230 and a second post receiving cylinder 235. First attachment post 220 may be received within first post receiving cylinder 230 with an interference fit or a friction fit. Similarly, second attachment post 225 may be received within second post receiving cylinder 235 with an interference fit or a friction fit. Other suitable attachment mechanisms may also be used to removably attach power source cover 190 to footwear 105.

Figure 3:
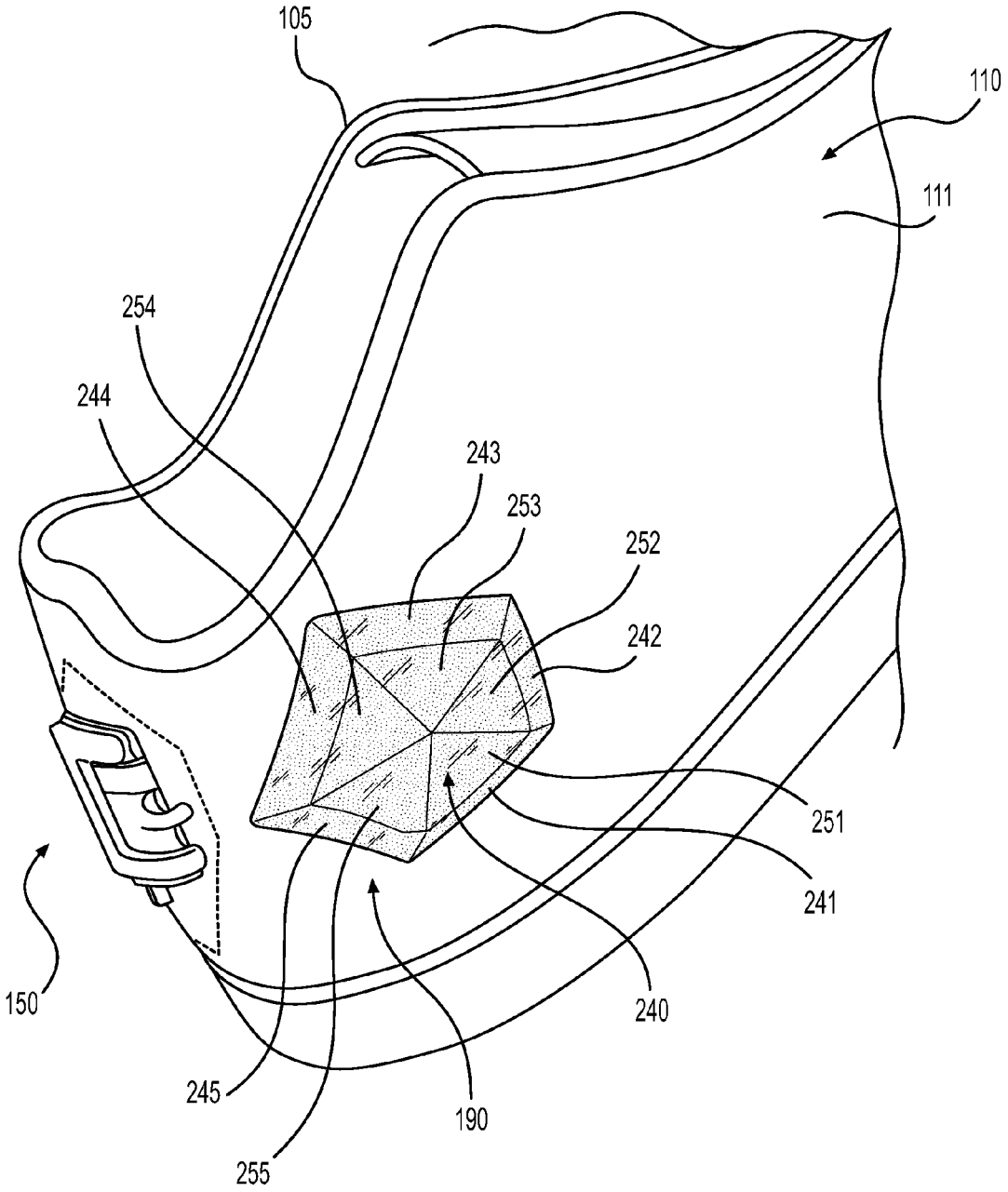
FIG. 3 is a perspective, assembled view of the article of footwear and power source cover shown in FIG. 2.

FIG. 3 is a perspective, assembled view of footwear 105 and power source cover 190 shown in FIG. 2. As shown in FIG. 3, power source cover 190 may have an outer surface 240, which may also be faceted in some embodiments. For example, as shown in FIG. 3, outer surface 240 may include a first perimeter facet 241, a second perimeter facet 242, a third perimeter facet 243, a fourth perimeter facet 244, and a fifth perimeter facet 245. In addition, outer surface 240 may include a first inner facet 251, a second inner facet 252, a third inner facet 253, a fourth inner facet 254, and a fifth inner facet 255. In some embodiments, the facets on the inner surface and outer surface of tensioning system component covers may correspond to one another.

Figure 4:
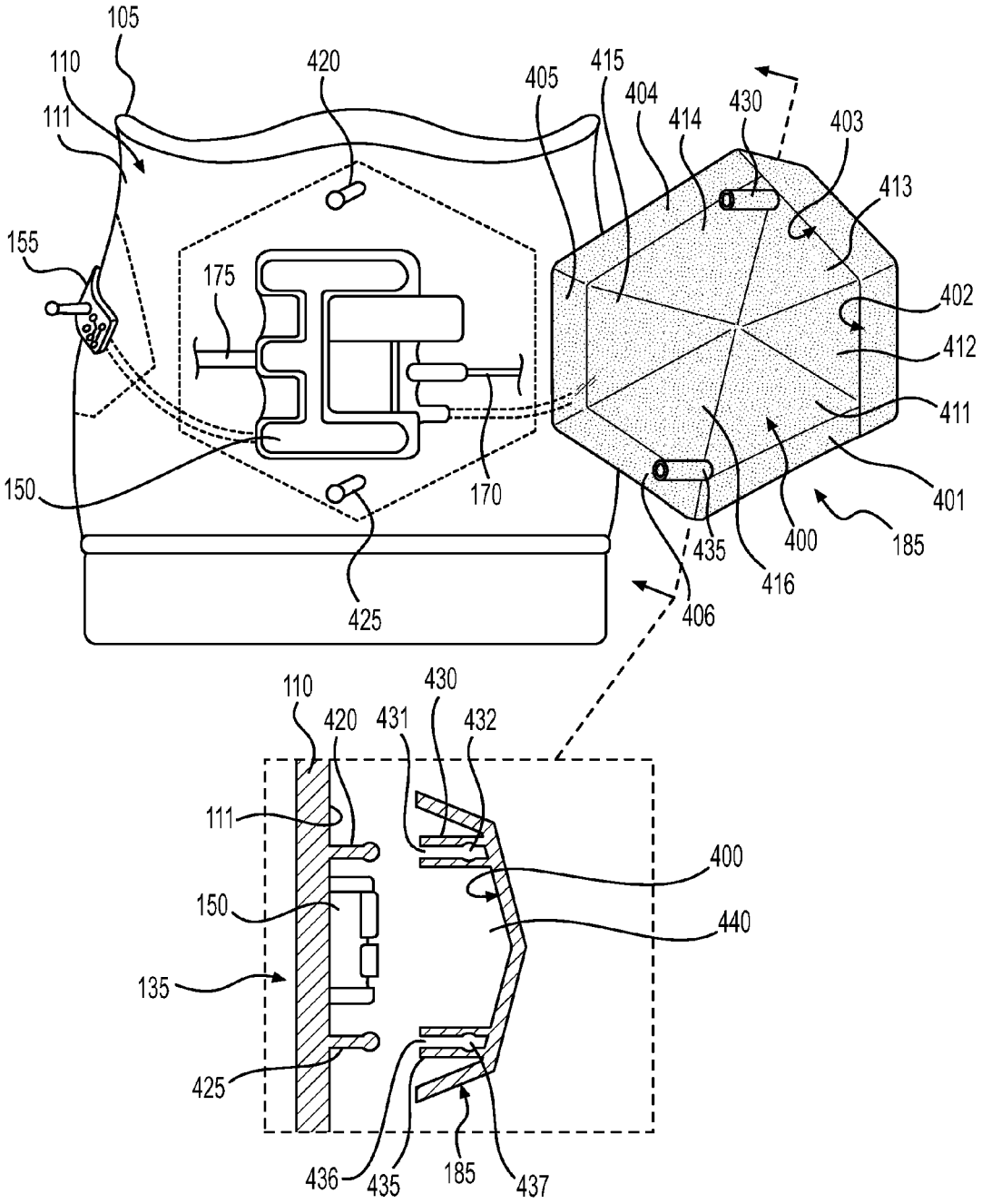
FIG. 4 is a schematic illustration of an exploded, rear view of an article of footwear and a tightening device cover.

FIG. 4 is a schematic illustration of an exploded, rear view of footwear 105 and tightening device cover 185. As shown in FIG. 4, first tensile member 170 and second tensile member 175 may enter tightening device 150 and may extend under at least one layer of upper 110.

Tightening device cover 185 may include an inner surface 400, which may have a first perimeter facet 401, a second perimeter facet 402, a third perimeter facet 403, a fourth perimeter facet 404, a fifth perimeter facet 405, and a sixth perimeter facet 406. In addition, inner surface 400 may include a first inner facet 411, a second inner facet 412, a third inner facet 413, a fourth inner facet 414, a fifth inner facet 415, and a sixth inner facet 416.

As shown in FIG. 4, tightening device cover 185 may be configured to be removably attached to outer surface 111 of upper 110 of footwear 105. In some embodiments, tightening device cover 185 may be removably attached to outer surface 111 by an interference fit connection or a friction fit connection. For example, in some embodiments, upper 110 may include a first attachment post 420 and a second attachment post 425. Tightening device cover 185 may include a first post receiving cylinder 430 and a second post receiving cylinder 435. First attachment post 420 may be received within first post receiving cylinder 430 with an interference fit or a friction fit. Similarly, second attachment post 425 may be received within second post receiving cylinder 435 with an interference fit or a friction fit. Other suitable attachment mechanisms may also be used to removably attach tightening device cover 185 to footwear 105.

FIG. 4 also includes a partial cross-sectional view of the rearmost heal portion of footwear 105, tightening device 150, and tightening device cover 185. As shown in FIG. 4, first post receiving cylinder 430 may include a first channel 431 configured to receive first attachment post 420. As further shown in FIG. 4, first channel 431 may include a first enlarged portion 432 configured to receive a bulbous portion at the end of first attachment post 432, thus forming an interference fit. Second post receiving cylinder 435 may include a second channel 436 configured to receive second attachment post 425. Further, second post receiving cylinder 435 may include a second enlarged portion 437 configured to receive a bulbous portion at the end of second attachment post 425 to provide an interference fit.

The cross-sectional view in FIG. 4 also shows that the faceted inner surface 400 of tightening device cover 185 may define concave contours configured to receive tightening device 150. For example, as shown in FIG. 4, tightening device cover 185 may define a cavity 440 configured to receive tightening device 150 when tightening device cover 185 is attached to outer surface 111 of upper 110.

Figure 5:
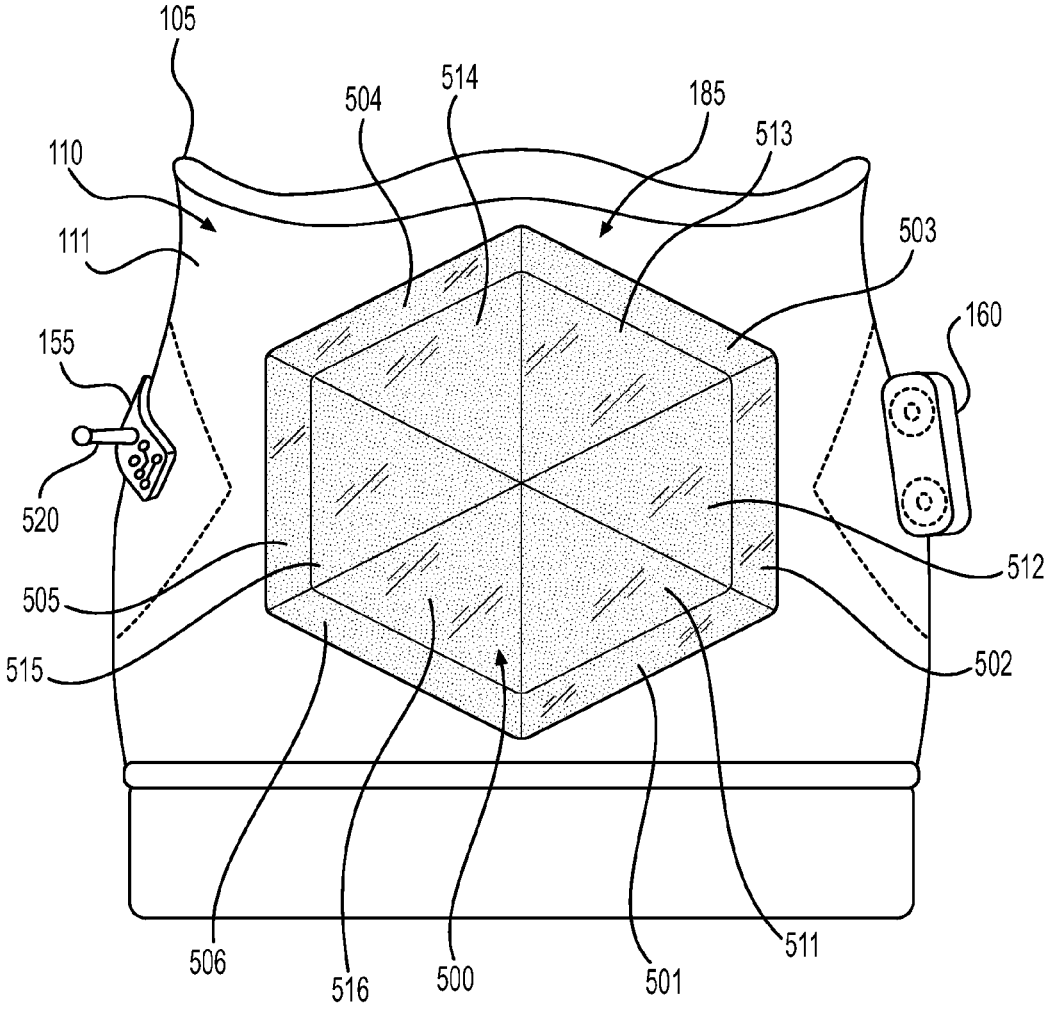
FIG. 5 is an assembled view of the article of footwear and tightening device cover shown in FIG. 4.

FIG. 5 is an assembled view of footwear 105, showing tightening device cover 185 attached to upper 110. As shown in FIG. 5, tightening device cover 185 may have a faceted outer surface 500. For example, outer surface 500 may include a first perimeter facet 501, a second perimeter facet 502, a third perimeter facet 503, a fourth perimeter facet 504, a fifth perimeter facet 505, and a sixth perimeter facet 506. In addition, outer surface 500 may include a first inner facet 511, a second inner facet 512, a third inner facet 513, a fourth inner facet 514, a fifth inner facet 515, and a sixth inner facet 516. Although FIG. 5 illustrates tightening device cover 185 as having a substantially regular polygonal shape, other, non-regular shapes may also be used.

Figure 6:
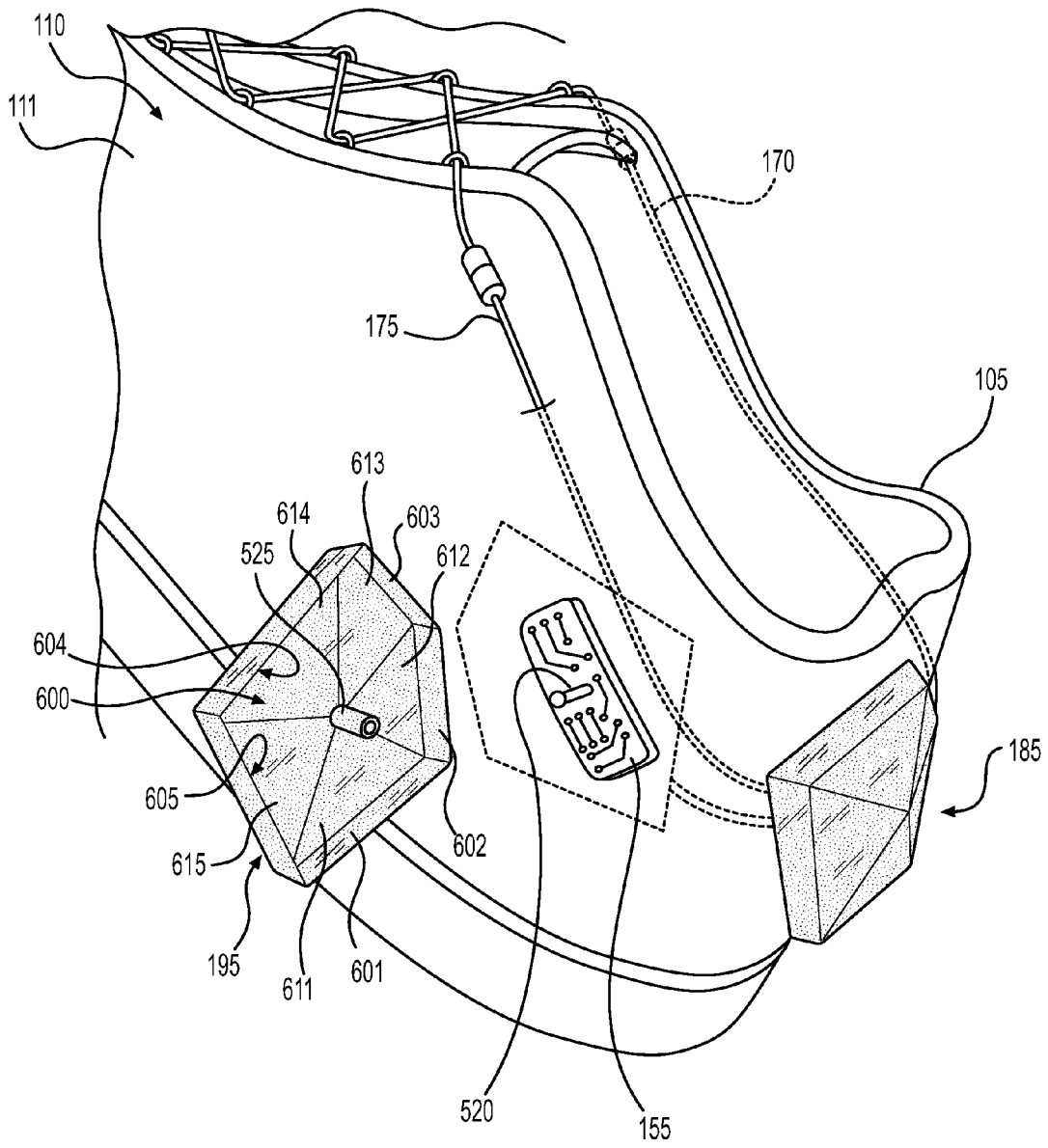
FIG. 6 is a schematic illustration of a side perspective view of an article of footwear and a control unit cover.

FIG. 6 is a schematic illustration of a side perspective view of footwear 105 and control unit cover 195. As shown in FIG. 6, control unit cover 195 may be removably attachable to footwear 105. For example, control unit 155 may include an attachment post 520 and control unit cover 195 may include a post receiving cylinder 525 configured to receive attachment post 520. This may provide an interference fit or friction fit connection that is the same or similar to that described above with respect to FIG. 4.

The faceted configuration of control unit cover 195 may define a concave contour configured to receive control unit 155. For example, as shown in FIG. 6, control unit cover 195 may include a faceted inner surface 600. In some embodiments, inner surface 600 may include a first perimeter facet 601, a second perimeter facet 602, a third perimeter facet 603, a fourth perimeter facet 604, and a fifth perimeter facet 605. In addition, inner surface 600 may also include a first inner facet 611, a second inner facet 612, a third inner facet 613, a fourth inner facet 614, and a fifth inner facet 615.

Figure 7:
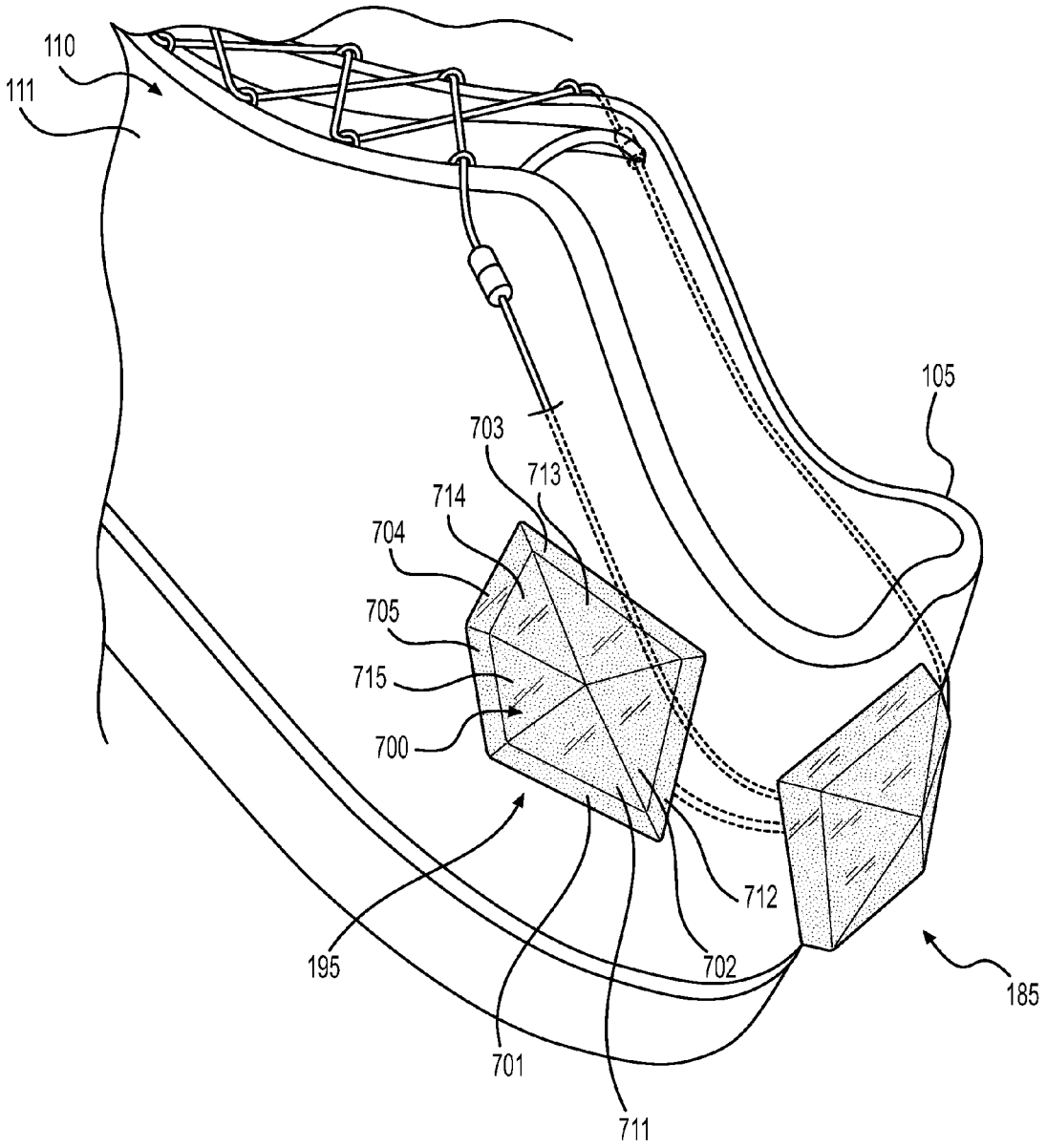
FIG. 7 is an assembled view of the article of footwear and control unit cover shown in FIG. 6.

FIG. 7 is an assembled view of footwear 105 and control unit cover 195. FIG. 7 also shows tightening device cover 185 attached to upper 110. As shown in FIG. 7 an outer surface 700 of control unit cover 195 may be faceted. For example, outer surface 700 may include a first perimeter facet 701, a second perimeter facet 702, a third perimeter facet 703, a fourth perimeter facet 704, and a fifth perimeter facet 705. In addition, outer surface 700 may include a first inner facet 711, a second inner facet 712, a third inner facet 713, a fourth inner facet 714, and a fifth inner facet 715.

In some embodiments, edges of tensioning system component covers that contact the outer surface of the upper may have contours configured to mate with the contours of the upper. For example, in some embodiments, the edges of the covers may have curvatures that correspond with the curvature of a heel region of the upper of the article of footwear. By having these mating curvatures, a close fit may be provided between the covers and the outer surface of the upper. This may substantially prevent debris from contacting the tensioning system components. This close fit may also substantially prevent apparel, such as pant leg cuffs from becoming pinched between the covers and the upper.

Figure 8:
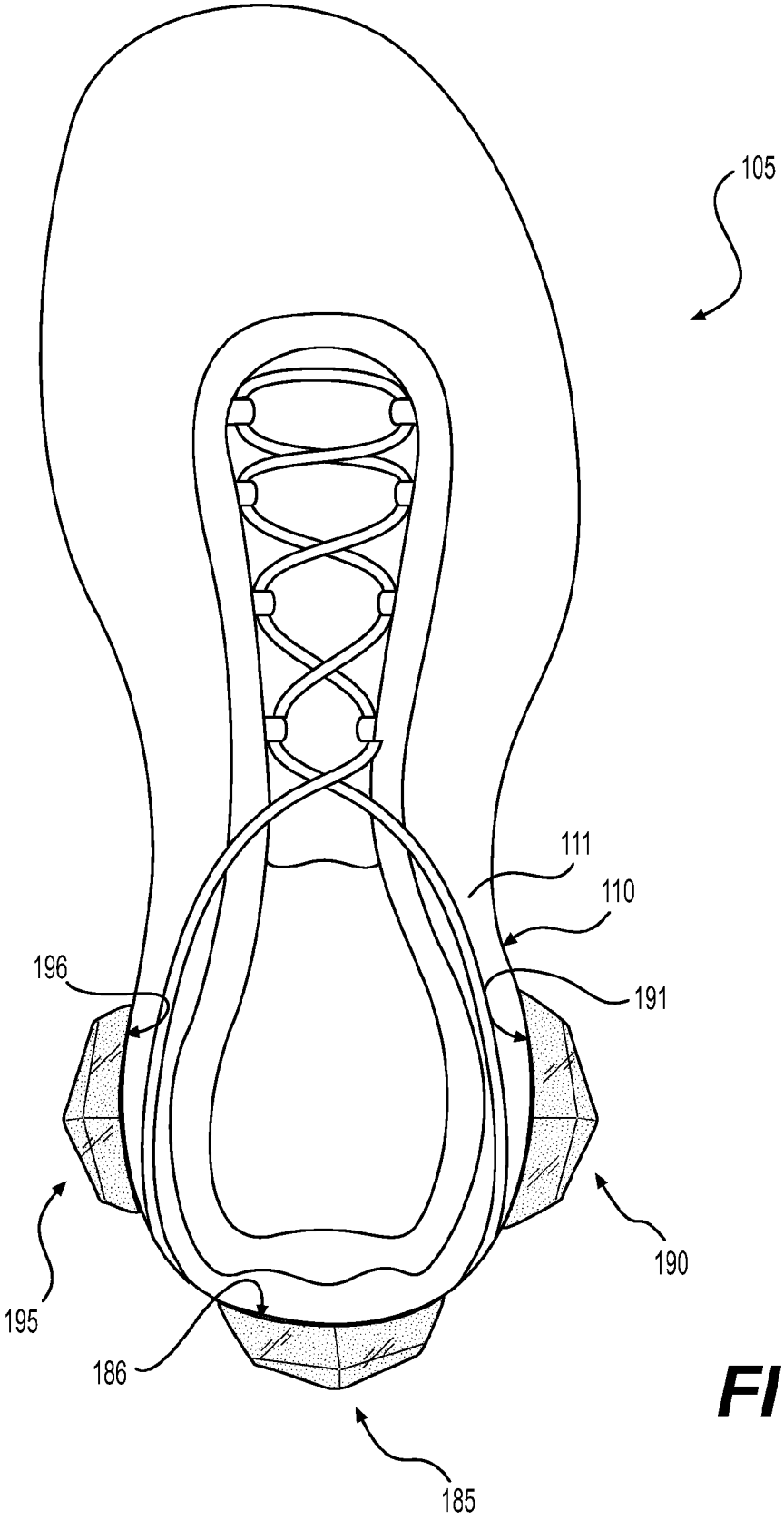
FIG. 8 is a top view of the article of footwear shown in FIG. 7.

FIG. 8 is a top view of footwear 105 with all three of the tensioning system component covers attached. As shown in FIG. 8, tightening device cover 185 may have a first contoured edge 186 that is curved to correspond with the curvature at the rearmost portion of the heel region of upper 110. Similarly, power source cover 190 may include a second contoured edge 191. As shown in FIG. 8, second contoured edge 191 may be curved to correspond with the curvature on the right side of the upper. Also, control unit cover 195 may include a third contoured edge 196. As shown in FIG. 8, third contoured edge 196 may be curved to correspond with the curvature on the left side of the upper.

In some other embodiments, buttons for tightening, loosening and/or performing other functions can be located directly on the footwear. As an example, some embodiments could incorporate one or more buttons located on or adjacent to the housing of a motorized tightening device. In still other embodiments, a motorized tightening device maybe controlled using voice commands. These commands could be transmitted through a remote device, or to a device capable of receiving voice commands that is integrated into the article and in communication with the motorized tightening device.

In some embodiments, the motorized tightening device may be configured to be controlled by a remote device. Accordingly, the footwear adjustment system may include a remote device configured to control the motorized tightening device. For example, in some embodiments, the remote device may include a bracelet, wristband, or armband that is worn by a user and specifically designed for communicating with the tensioning system.

In some embodiments, other types of mobile devices, such as mobile phones, may be configured to control the tensioning system. In some embodiments, the remote device may include a mobile phone, such as the iPhone made by Apple, Inc. In other embodiments, any other kinds of mobile phones could also be used including smartphones. In other embodiments, any portable electronic devices could be used including, but not limited to: personal digital assistants, digital music players, tablet computers, laptop computers, ultrabook computers as well as any other kinds of portable electronic devices. In still other embodiments, any other kinds of remote devices could be used including remote devices specifically designed for controlling the tensioning system. The type of remote device could be selected according to software and hardware requirements, ease of mobility, manufacturing expenses, as well as possibly other factors.

Figure 9:
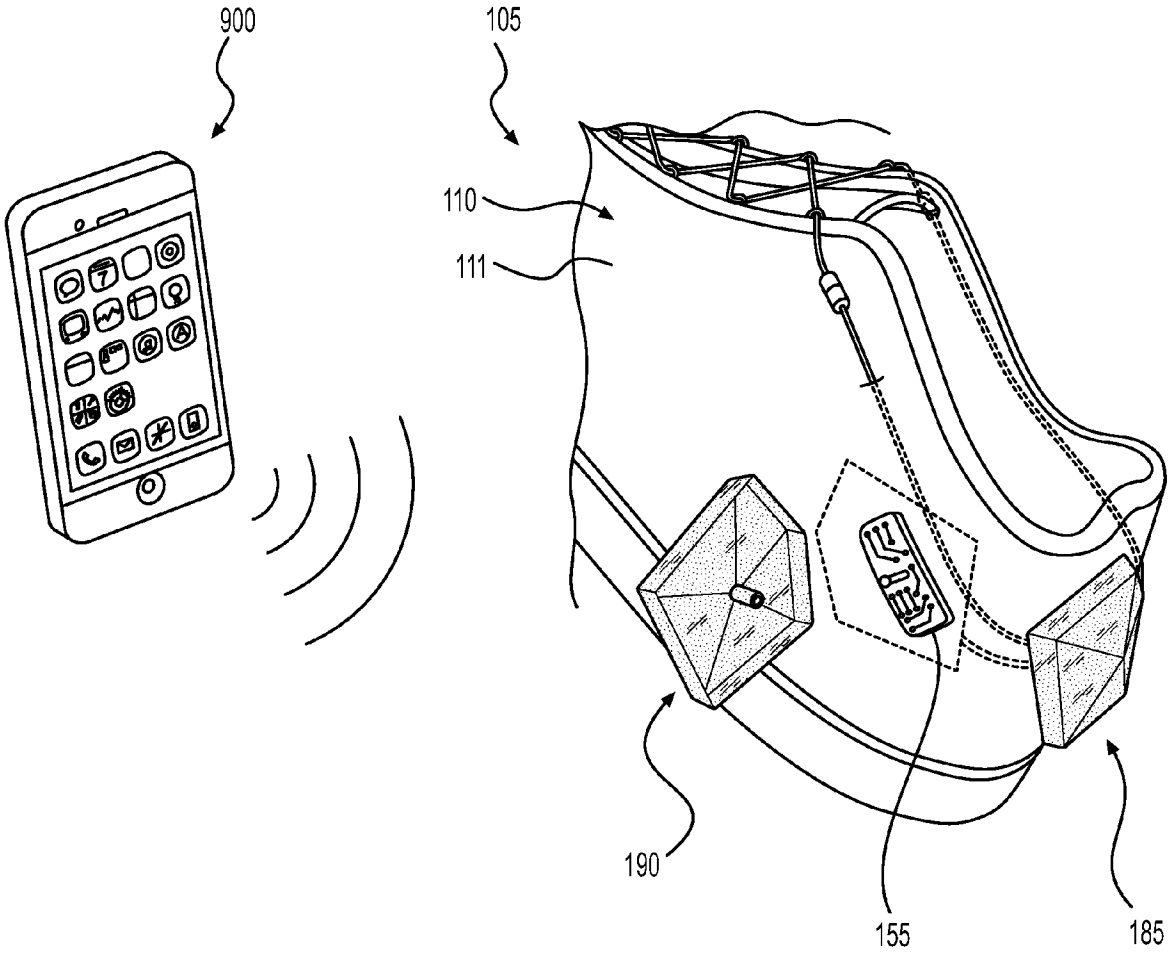
FIG. 9 is a schematic illustration of an article of footwear with a lace tensioning system and a remote device for controlling the tensioning system.

FIG. 9 is a schematic illustration of footwear 105 with a motorized tensioning system and a remote device 900 for controlling the tensioning system. In particular, FIG. 9 shows remote device 900 as a mobile phone. It will be understood that remote device 900 may be any suitable device for communicating with control unit 155.

In some embodiments, the control unit may be configured to communicate with the remote device. In some cases, the control unit may be configured to receive operating instructions from the remote device. Accordingly, the remote device may be configured to communicate instructions to the control unit. Therefore, control unit 155 may be configured to receive instructions from remote device 900 to apply increased tension to the tensile member by winding the spool. In some cases, remote device 900 may be capable of receiving information from control unit 155. For example, remote device 900 could receive information related to the current tension in the tensile member and/or other sensed information. Accordingly, in some embodiments, remote device 900 may function as a remote control that may be used by the wearer to operate the tensioning system.

Examples of different communication methods between remote device 900 and the tensioning system may include wireless networks such as personal area networks (e.g., Bluetooth®) and local area networks (e.g., Wi-Fi), as well as any kinds of RF based methods known in the art. In some embodiments, infrared light may be used for wireless communication. Although the illustrated embodiments detail a remote device that communicates wirelessly with the motorized tensioning system, in other embodiments the remote device and tensioning system may be physically connected and communicate through one or more wires.

The disclosed lace adjustment system may be usable to perform a variety of functions related to the tensioning of the tensile member. The tensioning system components and the remote device may be configured to perform any of the operative functions described in Beers, U.S. Patent Application Publication No. 2014/0082963, published on Mar. 27, 2014, and entitled "Footwear Having Removable Motorized Adjustment System," the entire disclosure of which is incorporated herein by reference.

Figure 10:
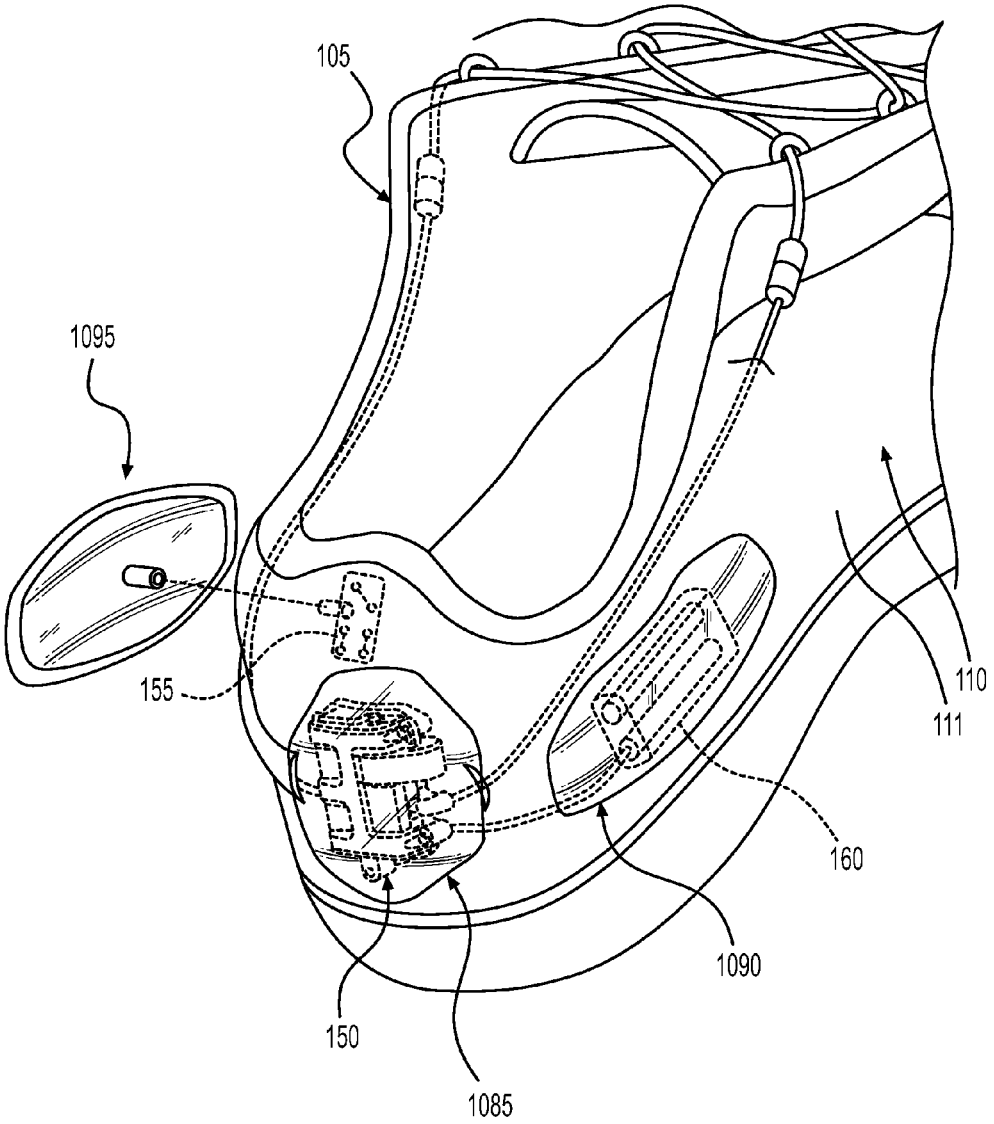
FIG. 10 is a schematic illustration of an exploded, rear perspective view of an article of footwear including a motorized tensioning system and individual covers for the components of the tensioning system.

FIG. 10 is a schematic illustration of an exploded, rear perspective view of footwear 105 with an alternative set of covers for the components of the tensioning system. As shown in FIG. 10, a second tightening device cover 1085 may be removably attached to upper 110 of footwear 105 over tightening device 150. Further, a second power source cover 1090 may be removably attached to upper 110 over power source 160. In addition, a second control unit cover 1095 may be configured to be removably attached to footwear 105 over control unit 155.

As shown in FIG. 1, these second covers may be interchangeable with the faceted covers described above. As opposed to the faceted configurations described above, second tightening device cover 1085, second power source cover 1090, and second control unit cover 1095 may have substantially smoothly contoured outer surfaces. The substantially smoothly contoured outer surfaces may prevent edges of the covers from catching on the wearer's other shoe or on obstacles. For example, during athletic activities, smoothly contoured covers may be beneficial in preventing the wearer from catching a cover on the footwear of an opponent. When contact is made with a smoothly contoured cover, the cover may merely glance off, with little or no impedance to the motion of the wearer's foot.

Figure 11:
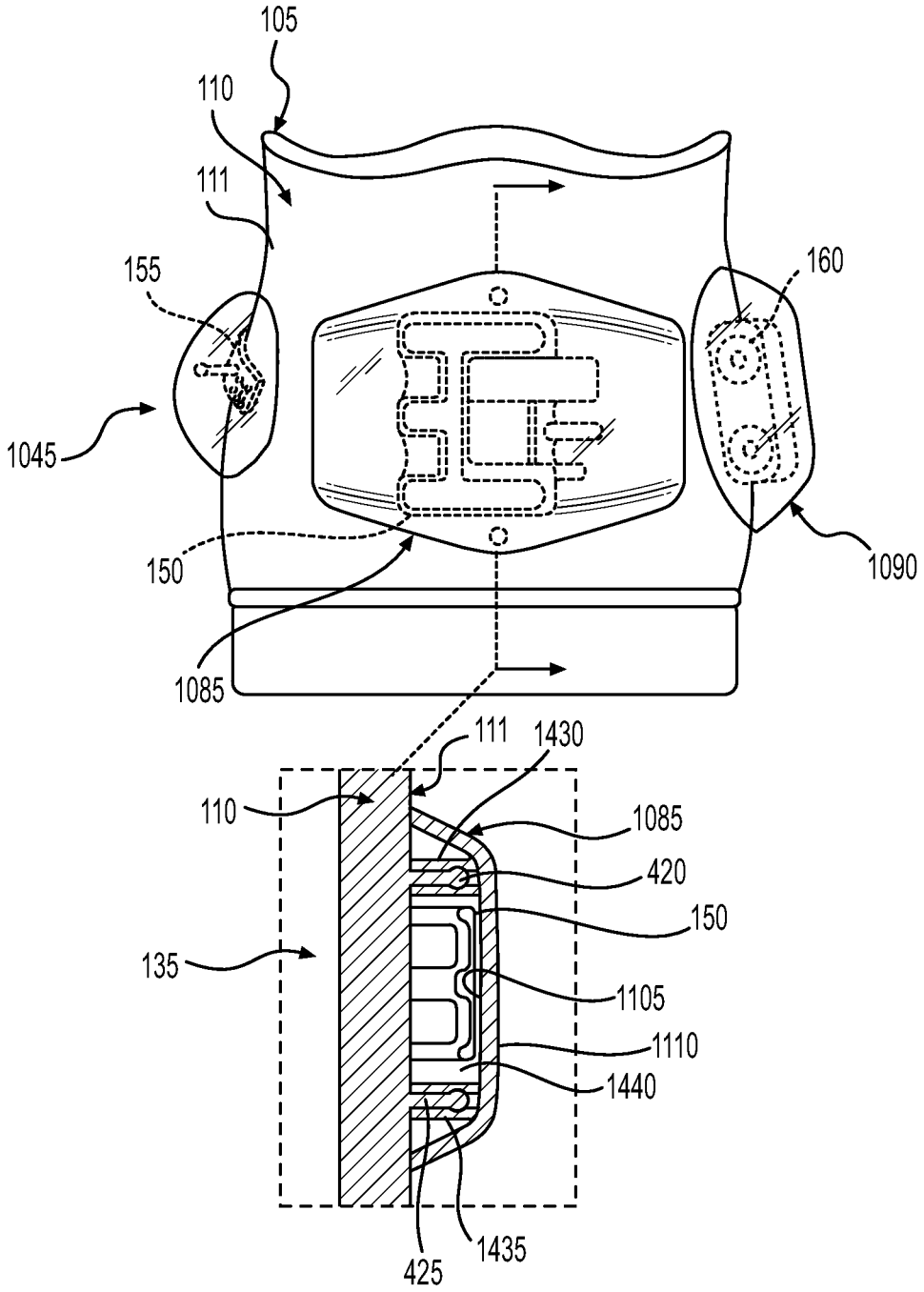
FIG. 11 is a schematic illustration of a rear view and partial cross-sectional view of the article of footwear shown in FIG. 10.

FIG. 11 is a schematic illustration of a rear view and partial cross-sectional view of footwear 105 with the second set of covers attached. As shown in FIG. 11, second tightening device cover 1085, second power source cover 1090, and second control unit cover 1095 may have smooth contours. As shown in the partial cross-sectional view in FIG. 11, second tightening device cover 1085 may have an outer surface 1110 having a smoothly contoured profile, that is, without facets. As further shown in FIG. 11, second tightening device cover 1085 may have an inner surface 1105 that is concavely contoured to define a cavity 1440 configured to receive tightening device 150.

As also shown in FIG. 11, second tightening device cover 1085 may be configured to attach to outer surface 111 of upper 110 of footwear 105 with the same connection mechanism as the faceted tightening device cover discussed above. For example, in some embodiments, second tightening device cover 1085 may include a first post receiving cylinder 1430 configured to receive first attachment post 420 and a second post receiving cylinder 1435 configured to receive second attachment post 425 of upper 110 in an interference fit or friction fit connection.

Figure 12:
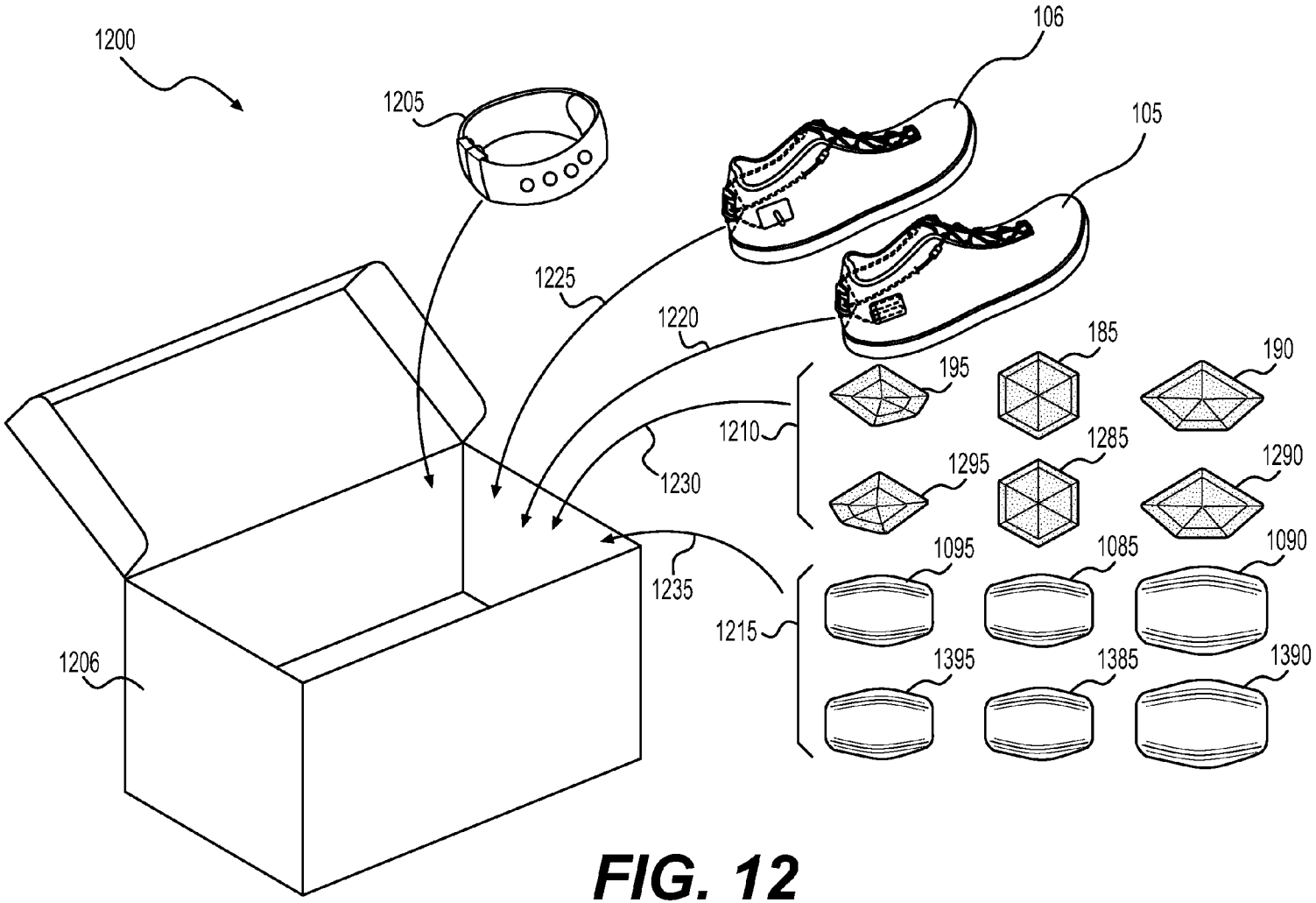
FIG. 12 is a schematic illustration of motorized lacing system including interchangeable component covers.

FIG. 12 is a schematic illustration of motorized footwear lacing system including 1200 including interchangeable tensioning system component covers. As shown in FIG. 12, system 1200 may include footwear 105, as well as tightening device cover 185, power source cover 190, and control unit cover 195. System 1200 may also include a second article of footwear 106 matching with footwear 105 (for example, a right and left pair). Accordingly, system 1200 may include a second faceted tightening device cover 1285 configured to be attached to footwear 106 over a tightening device, a second faceted power source cover 1290 configured to be attached to footwear 106 over a power source, and a second faceted control unit cover 1295 configured to be attached to footwear 106 over a control unit. Thus, system 1200 may include a first set of component covers 1210, which may include tightening device cover 185, power source cover 190, and control unit cover 195, second faceted tightening device cover 1285, second faceted power source cover 1290, and second faceted control unit cover 1295.

In some cases the arrangement of the tensioning system components may be medial/lateral specific. Accordingly, in some cases, the second faceted covers may be mirror images of their counterpart for the mating shoe. For example, control unit cover 195 and second faceted control unit cover 1295 are illustrated as having mirror images, in order to fit over the control units of footwear 105 and footwear 106, which are disposed on the medial side of each shoe. In other cases, the covers may have horizontal and/or vertical symmetry, as shown in FIG. 12.

As shown in FIG. 12, system 1200 may also include a second set of tension system component covers 1215. As shown in FIG. 12, second set of covers 1215 may have different external shapes than first set of covers 1210. For example, second set of covers 1215 may include second tightening device cover 1085, second power source cover 1090, and second control unit cover 1095. In addition, second set of covers 1215 may further include covers for the mating footwear 106, including a second contoured second contoured tightening device cover 1385, a second contoured power source cover 1390, and a second contoured control unit cover 1395.

First set of covers 1210 may be interchangeable with second set of covers 1215. The sets of covers may be attached to the footwear as complete sets or as individual covers by mixing and matching faceted covers with smoothly contoured covers.

As shown in FIG. 12, system 1100 may be a kit of parts. Accordingly, the kit of parts may include a container 1206 configured to contain footwear 105 and other components of system 1200. For example, in some cases, container 1206 may be a shoebox. The various components of system 1200 may be included in container 1206. For example, footwear 105 may be included in container 1206 as indicated by a first arrow 1220. Mating footwear 106 may also be included, as indicated by a second arrow 1225. First set of covers 1210 may be included, as indicated by a third arrow 1230. Further, second set of covers 1215 may be included, as indicated by a fourth arrow 1235.

FIG. 12 also illustrates a remote device 1205, which may also be included in container 1206. Remote device 1205 is illustrated as a bracelet or watch. The features of remote device 1205 may be the same or similar to the remote devices discussed above.

In some embodiments, a method of changing a lacing system of an article of footwear may include removing a first tightening device cover from the article of footwear and removably attaching a second, interchangeable tightening device cover to the article of footwear over the tightening device. The covers for the power source and control unit may be similarly interchanged.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

The invention claimed is:

1. A motorized footwear lacing system, comprising:

an article of footwear;

a motorized tensioning system including a tensile member and a motorized tightening device attached to an outer surface of the article of footwear, the tightening device configured to apply tension in the tensile member to adjust the size of an internal void defined by the article of footwear; and a control unit and a power source incorporated into the motorized tensioning system, the control unit and the power source being attached to an outer surface of the article of footwear;

a first set of component covers configured to be removably attached to the outer surface of the article of footwear, the first set of component covers including a first tightening device cover configured to be removably attached over the tightening device, a first control unit cover configured to be removably attached over the control unit, and a first power source cover configured to be removably attached over the power source; and a second set of component covers configured to be removably attached to the outer surface of the article of footwear, the second set of component covers including a second tightening device cover configured to be removably attached over the tightening device, a second control unit cover configured to be removably attached over the control unit, and a second power source cover configured to be removably attached over the power source;

wherein the first tightening device cover is interchangeable with the second tightening device cover, the first control unit cover is interchangeable with the second control unit cover, and the first power source cover is interchangeable with the second power source cover.

2. The system of claim 1, further including a container configured to contain the article of footwear, and the tensioning system, including the first set of component covers and the second set of component covers.

3. The system of claim 1, wherein the first tightening device cover and the second tightening device cover have different external shapes.

4. The system of claim 1, wherein the first tightening device cover and the second tightening device cover attach to the outer surface of the article of footwear with the same connection mechanism.

5. The system of claim 4, wherein the first tightening device cover and the second tightening device cover attach to the outer surface of the article of footwear with an interference fit connection.

6. The system of claim 1, wherein the motorized tightening device is configured to be controlled by a remote device.

7. The system of claim 6, further including a remote device configured to control the motorized tightening device.

8. The system of claim 7, wherein the remote device includes a bracelet.

9. The system of claim 1, wherein at least one of the first tightening device cover, the first control unit cover, and the first power source cover is removably attached to the article of footwear with an interference fit connection.

10. The system of claim 1, wherein at least one of the tightening device, the control unit, and the power source is removably attached to the article of footwear.

11. The system of claim 1, wherein at least one of the tightening device, the control unit, and the power source is attached to a heel portion of the article of footwear.

12. The system of claim 1, wherein the first tightening device cover includes a faceted inner surface defining concave contours configured to receive the tightening device.

13. The system of claim 1, wherein edges of the first tightening device cover are contoured to mate with a contoured portion of the outer surface of the article of footwear.

14. The system of claim 1, wherein, the tightening device is attached to the heel portion of the article of footwear in a rearmost portion of the article of footwear.

15. The system of claim 1, wherein, the control unit and the power source are located on opposing sides of the article of footwear in a heel region of the article of footwear.

* * * * *